United States Patent [19]

Arasmith

[11] Patent Number: 4,569,380

[45] Date of Patent: Feb. 11, 1986

[54] WOOD CHIPPING KNIFE AND APPARATUS USING SAME

[76] Inventor: Stanley D. Arasmith, P.O. Box 2458, Rome, Ga. 30164

[21] Appl. No.: 647,676

[22] Filed: Sep. 5, 1984

Related U.S. Application Data

[63] Continuation-in-part of Ser. No. 533,260, Sep. 16, 1983, abandoned.

[51] Int. Cl.[4] ..... B27C 1/00

[52] U.S. Cl. ..... 144/172; 144/176; 144/241; 241/294

[58] Field of Search ..... 241/294; 144/162 R, 144/172, 174, 176, 241

[56] References Cited

U.S. PATENT DOCUMENTS

| | | | |
|---|---|---|---|
| 2,825,371 | 4/1958 | Forman | 144/174 |
| 3,304,970 | 2/1967 | Altosaar | 144/176 |
| 3,907,016 | 9/1975 | Nicholson et al. | 144/172 |
| 4,161,972 | 7/1979 | Hanaya | 144/176 |

*Primary Examiner*—W. D. Bray

*Attorney, Agent, or Firm*—Jones & Askew

[57] ABSTRACT

An improved cutter knife for wood chip producing apparatus includes two cutting edges intersecting at an angle of 52½ degrees. This knife allows wood to be fed perpendicularly into a knife holding disc or drum requiring less space and less power for the production of the wood chips. The improved knife also produces chips of precise dimensions.

12 Claims, 14 Drawing Figures

136
37.5°
52.5°
170
140
170
c = 3/4

41°
49°
141
c = 7/8

47°
45°
142
c = 1 1/16

56°
34°
143
c = 1 1/2

167
165
136
125
125
125
10
160
30°
45°
60°
120

WOOD CHIPPING KNIFE AND APPARATUS USING SAME

CROSS-REFERENCE TO RELATED APPLICATION

This application is a continuation-in-part of U.S. application Ser. No. 533,260, filed Sept. 16, 1983 now abandoned.

TECHNICAL FIELD

The present invention relates to the processing of wood, usually in the form of logs, into chips, and more particularly relates to an improved knife for wood processing systems.

BACKGROUND ART

In wood processing machines used to process logs into chips, it has been common for the machines to include a plurality of knives mounted either on the face of a rotary disc or on the surface of a rotating drum. The logs are then guided into the disc or drum so that the knives can cut through the wood. With knives used in the prior art, it is preferable to orient the log at an angle of about 37½–38 degrees with respect to the path of travel of the knives through the wood in order to minimize the power required to drive the knives across the grain of the wood. When using a disc type machine, the log should be fed at an angle with respect to the disc while feeding it into the blades. This arrangement requires a large amount of space for the wood processing apparatus.

When using a rotating drum type apparatus equipped with knives of the prior art, the log can be angled or can be fed straight toward the drum. However, in the latter case the log must be fed into the bottom portion of the rotating drum, as shown in U.S. Pat. No. 2,710,635, in order to take advantage of cutting the wood at the more efficient 38 degree angle. This requires a very large drum relative to the log diameter since only a small portion of the circumferential surface provides the proper angle for cutting.

The knives conventionally utilized in such known wood processing machines generally have a linear cutting edge formed by double grinding a metal blank to form a sharp edge between the back surface of the knife and an end face. Such a primary edge generally extends parallel to the surface of the disc or drum. Some of the knives in the prior art have wing edges that extend laterally from the side of the primary cutting edge and are angled from the plane of the primary edge in order to cut another side of the chip to provide a more uniformly shaped chip. Examples of this type of knife are found in U.S. Pat. Nos. 3,219,076 and 3,559,705.

The knives of the prior art machines have generally failed to produce wood chips of as uniform a width, grain length and thickness as is desired in many industries. For example, in the manufacture of chemical wood pulp for use in making paper, it is important that the wood chips employed be of as nearly uniform dimensions as possible, since the rate of penetration of the cooking liquors for digesting the wood, that is, for converting it into pulp, is dependent in part on the dimensions of the chips to be digested. It has also been recognized that conventional wood chippers as employed for the production of chips used in the manufacture of pulp can damage the wood fibers and thus result in lowered pulp quality.

In U.S. Pat. No. 4,161,972, logs are fed directly into the surface of a disc chipper. However, the knife shown therein makes a major cut along the grain of the wood, and makes only a very small cut equal to the smallest dimension of the chip (typically ¼ inch) across the grain. The angled cutting edge of the knife of this patent is angled only about 7–10 degrees from the surface of the disc. The knife thus is not operating at an efficient angle, and is limited to a very small cut to prevent power requirements from becoming excessive. The number of knives required to remove a layer of wood from the end of a log using this apparatus is excessive. The patentee teaches against using his concepts in a drum chipper.

The prior art thus has lacked a chipper which permits logs to be fed end-on into a knife mounting surface without requiring an excessive amount of power to cut directly across the grain, or an excessive number of small knives.

SUMMARY OF THE INVENTION

The present invention provides an improved wood processing apparatus comprising a cylindrical drum mounted for rotation about a longitudinal axis thereof; means for feeding a wooden member toward the drum with the grain of the wood member alinged such that a radius of the drum passes through the wooden member parallel to the grain; and a knife mounted to protrude from the cylindrical surface of said drum, the knife defining a first cutting edge positioned to form an angle of approximately 35 to 40 degrees with the surface of the drum. An apparatus thus constructed can efficiently chip logs fed directly into the drum across the entire cross-section of the drum. The chips can be more precisely defined by the provision of a second cutting edge extending within a radial plane of the drum from an end of the first cutting edge farthest from the cylindrical surface of the drum toward the drum. The knife can further comprise gullet faces and heel faces defining the edges, such faces positioned to fracture wood removed by the knife along at least four fracture lines parallel to the second cutting edge.

The wood processing apparatus of the invention can also be embodied in a disc mounted for rotation about an axis and having a generally flat surface perpendicular to such axis; means for feeding a wooden member toward the surface with the grain of the wooden member alinged perpendicular to the surface; and a knife mounted to protrude from the surface, the knife defining a first cutting edge positioned to form an angle of about 35 to 40 degrees with the surface.

Thus, by orienting the cutting edges of the wood chipping knife as described in the present invention, the mechanical advantage of cutting across the grain of the wooden member at an efficient angle without having to angle the wooden member itself is achieved. A disc chipper embodying the invention drives a shorter cumulative knife length through the wood at any given time and thus requires less horsepower for cutting than a standard disc chipper. The full diameter of the drum of a drum chipper embodying the invention can be utilized rather than only a fraction thereof, enabling the cutting of larger logs or multiple logs simultaneously.

Although a knife embodying the present invention can be used advantageously in any wood processing operation, such a knife is particularly useful in the production of a wood chip ideally suited for use in the wood pulp industry.

Thus, it is an object of the present invention to provide an improved wood processing apparatus.

It is a further object of the invention to provide an apparatus for efficient chipping logs fed end-on into the knive-holding surface.

It is further object of the present invention to provide an improved wood chipping knife that will create a uniformly shaped wood chip.

It is a further object of the present invention to provide a wood processing knife that penetrates easily into wood.

It is a further object of the present invention to provide an improved wood processing apparatus that will require less power to process wood.

It is a further object of the present invention to provide an improved wood processing knife that will produce less noise during the wood chipping process.

Other objects, features, and advantages of the present invention will become apparent upon review of the following detailed description of embodiments of the invention, when taken in conjunction with the drawing.

DETAILED DESCRIPTION

Figure 1:
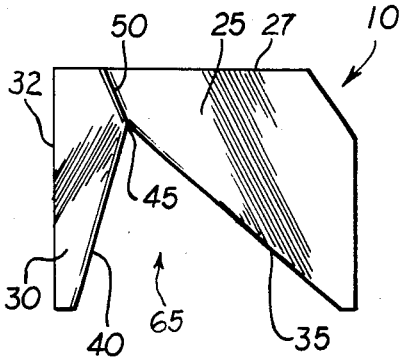
FIG. 1 is a front end view of the knife embodying the present invention.
Figure 3:
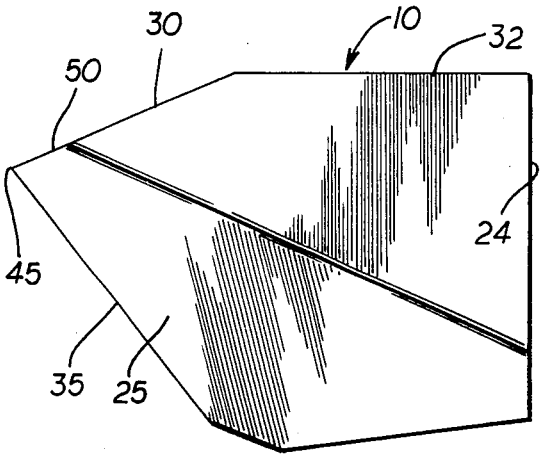
FIG. 3 is a top plan view of the knife embodying the present invention.
Figure 2:
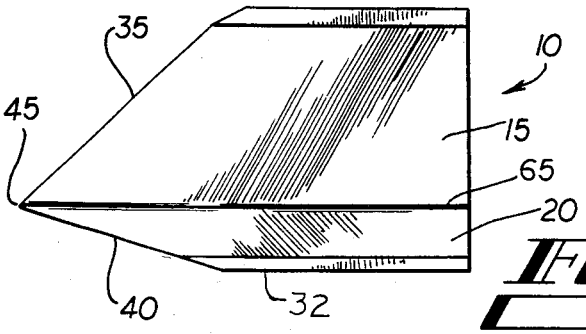
FIG. 2 is a bottom plan view of the knife embodying the present invention.

Referring now in more detail to the drawing, in which like numerals represent like parts throughout the several views, FIGS. 1–3 show a knife 10 embodying the present invention. The knife 10 is machined from a metal blank, and includes a first gullet face 15 and a second gullet face 20. FIG. 1 shows a first heel face 25 and a second heel face 30. The first heel face 25 is slanted or beveled toward a top face 27 while the second heel face is perpendicular to the top face 27 and is beveled to form an obtuse angle with a side face 32 shown in profile in FIG. 3.

The first heel face 25 and the first gullet face 15 meet to form a first cutting edge 35. The second heel face 30 and the second gullet face 20 meet to form a second cutting edge 40. In the knife embodying the present invention, the first and second cutting edges 35 and 40 intersect at point 45 to form an acute angle A which is preferably 52½ degrees. This provides a V-shaped cutting edge at the desired angles to minimize the power required to drive the knives across the grain of the wood in the manner described below. In FIG. 1 is shown that the first heel face 25 and the second heel face 30 meet to form heel edge 50. Heel edge 50 is rearwardly angled from point 45 to the top surface 27 to provide clearance for the cutting edges as shown in FIG. 3. The point 45 penetrates into the wood and the cutting edges 35 and 40 then cut a uniform chip from the wood in a manner described below.

Figure 5:
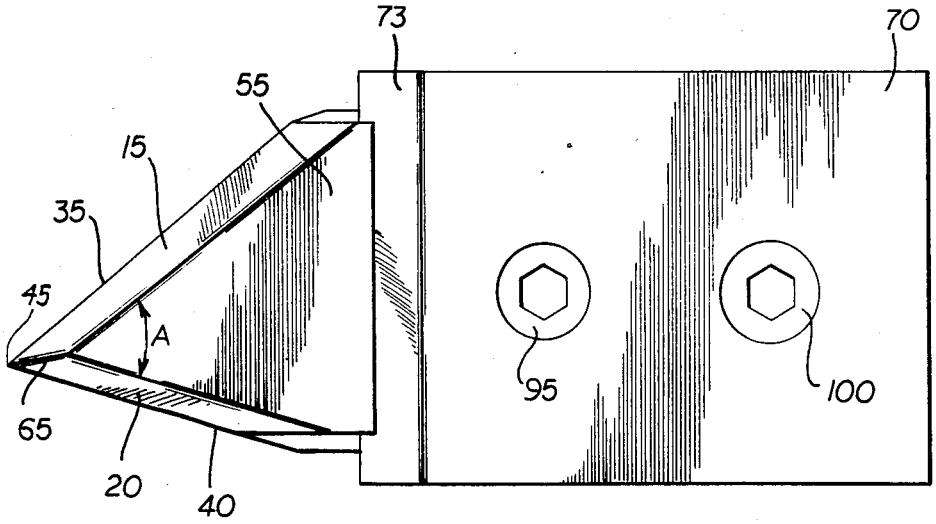
FIG. 5 is a bottom plan view of the knife assembly shown in FIG. 4.

In assembled form, the knife 10 also includes an inwardly spaced third gullet face 55 shown in FIG. 5. The triangular third gullet face 55 is formed by a knife receiving block 60 shown in FIG. 6. The knife receiving block 60 is triangular in shape in cross section to be matingly received into a V-shaped longitudinal groove 65 shown in FIGS. 2 and 6 formed by the intersection of the first gullet face 15 and the second gullet face 20.

The knife 10 is made easy to sharpen by the configuration of the groove 65, which extends completely through the blank from which the knife is made, and that of the heel faces 25 and 30, which extend unobstructed to edges of the blank.

Figure 4:
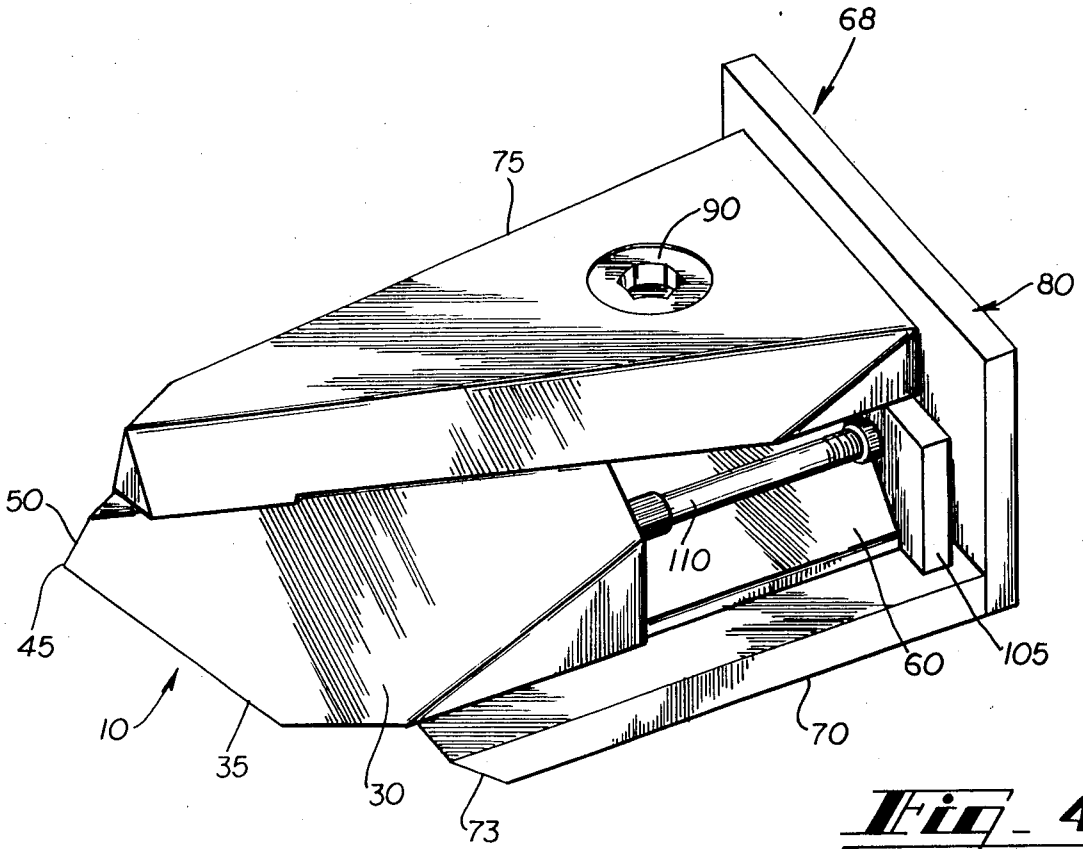
FIG. 4 is an isometric view of a knife and the means for clamping the knife embodying the present invention.
Figure 6:
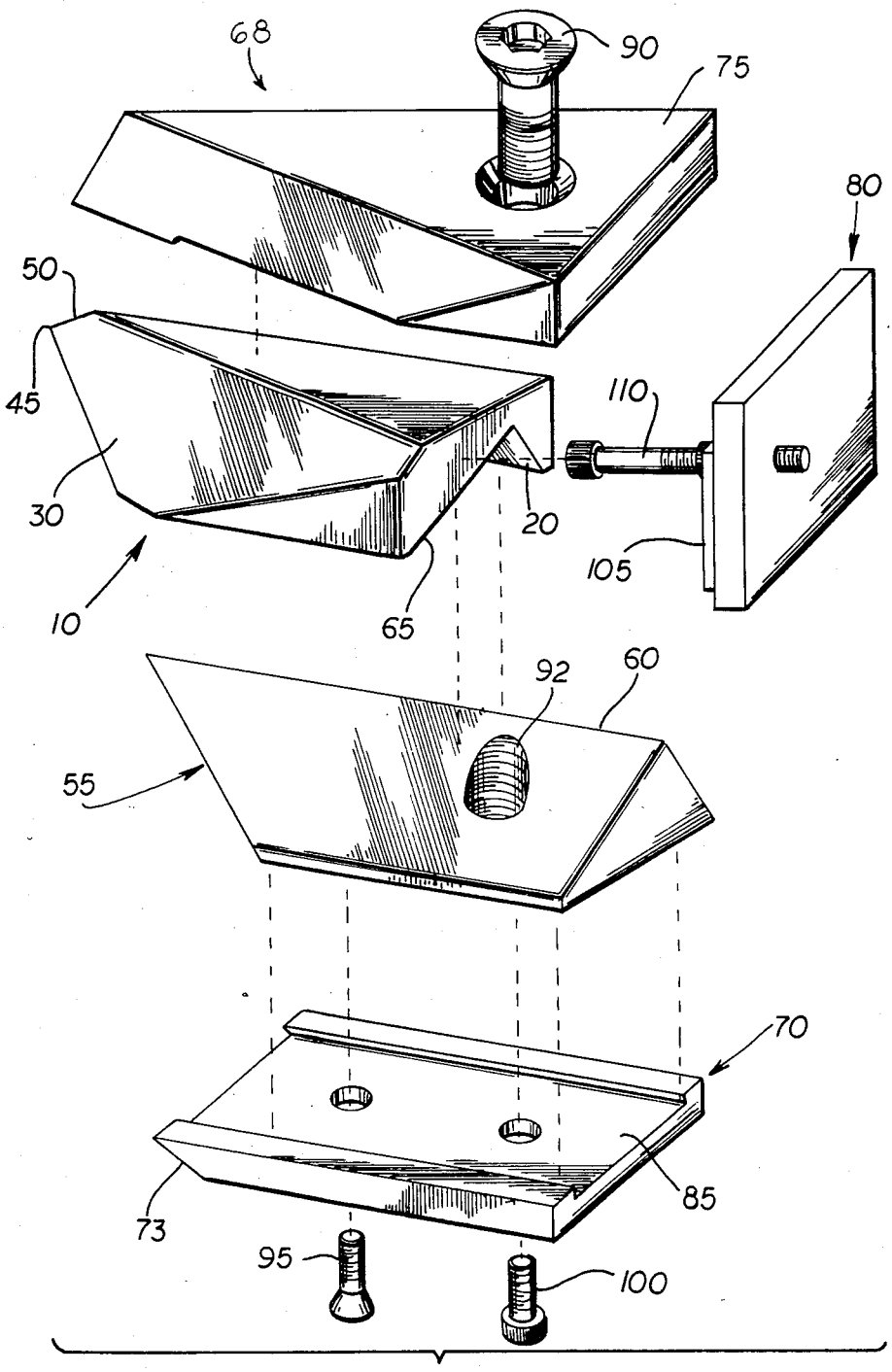
FIG. 6 is an exploded perspective view of the knife shown in FIG. 4.

A knife holder 68 for the knife 10 is shown in FIGS. 4 and 6 and comprises a flat bottom plate 70, a flat top clamping plate 75 and a rear plate 80. The knife receiving block 60 fits into a longitudinal knife receiving block groove 85 in the flat bottom plate 70, which also defines a rearwardly angled front face 73. The flat bottom plate 70 is secured in place by two bolts 95, 100 which are threadably engaged into the bottom of the knife receiving block 60. The flat top clamping plate 75 bears upon the top of the knife 10 and is secured in place by a clamping bolt 90 which is threadably engaged into threaded opening 92 on the top of the knife receiving block 60. The rear plate 80 comprises a rectangular rear block extension 105 that provides a second bearing surface for the top clamping plate 75 and is clamped between the flat top clamping plate 75 and the flat bottom plate 70. An adjusting bolt 110 is threadably engaged into the rear plate, one end of the adjusting bolt butting against the knife 10 allowing adjustment of the longitudinal position of the knife 10 in the knife holder 68 to accomplish depth of cut adjustments and also preventing the knife 10 from slipping rearwardly during the cutting operation.

Figure 7:
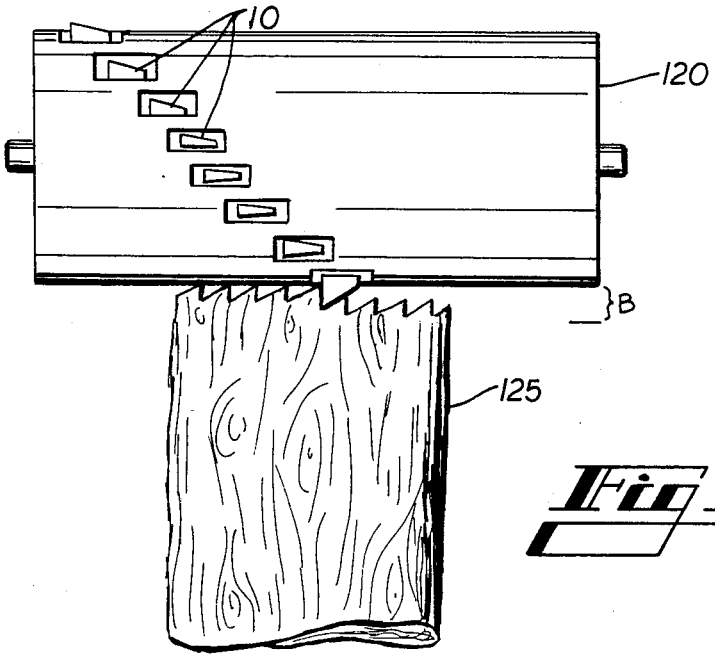
FIG. 7 is a diagrammatic plan view of a log being fed into a drum chipper embodying the invention.
Figure 8:
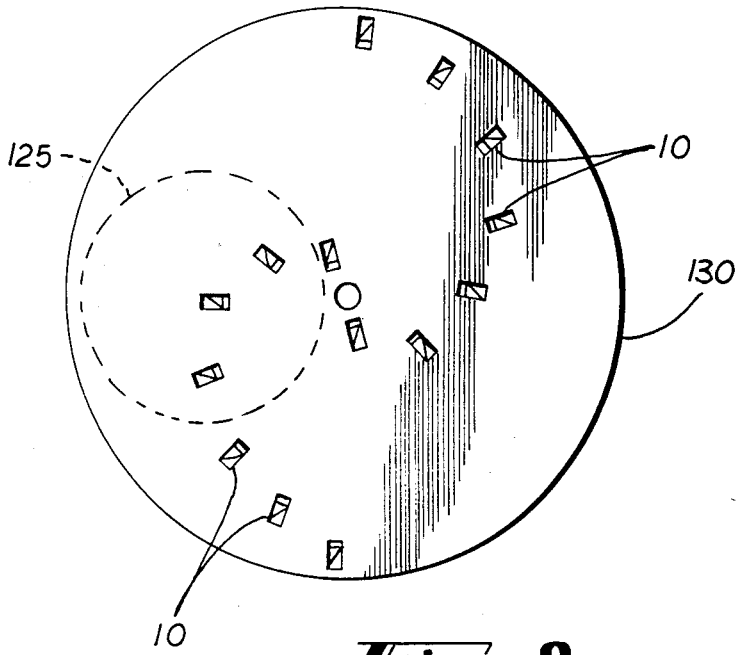
FIG. 8 is a diagrammatic plan view of a log being fed into a disc chipper embodying the invention.

FIG. 7 shows a plurality of knives 10 mounted in a helical sequence around the circumferential surface of a drum 120. FIG. 8 shows a plurality of knives 10 mounted in a spiral sequence on a disc 130. The cutting edge of the knife 10 protrudes beyond the periphery of the drum or disc a distance of approximately one and one-half inches. The drum 120 or disc 130 rotates, causing the cutting edges of the knives 10 to cut material in the form of successive rectangular parallelepipeds from the end of the log 125 that is urged perpendicularly into the drum 120 or disc 130 by a conventional log-handling apparatus shown in FIG. 10 in the case of a drum. Logs 125 are confined on a conveyor 165 by posts 167 positioned at the ends of the drum. The conveyor 165 urges the logs into the surface of the drum from which the knives 10 protrude. It should be noted that a drum constructed according to the invention can accept logs fed directly at the horizontal centerline of the drum, and can accept a plurality of logs stacked to be fed into the entire vertical and horizontal cross-section of the drum.

The knife holder 68 is mounted in a manner (not shown) known to those skilled in the art in a recess in the surface of a drum or in the flat side of a disc with the cutting edges protruding beyond the surface of the drum or disc. The mounting position is such in a drum 120 that when the knife is rotated to the horizontal midline of the drum, as shown at line 160 in FIG. 10, the cutting edges 35 and 40 are in a horizontal plane, with the first cutting edge at a preferred angle of 37.5 degrees from the surface of the drum, and the second cutting edge lying in a radial plane of the drum 120. The heel face 30 is almost in the same radial plane, but must be tilted slightly from the vertical by a heel clearance angle H, shown in FIG. 3, for reasons well known to those skilled in the art.

The angle A between the cutting edges can vary but only slightly from the preferred angle of 52.5 degrees. If the angle is made too acute, it would be awkward to position the knife to maintain heel clearance without grinding back the heel faces 25 and 30. Too much grinding would make the angles between the heel faces and the respective gullet faces 15 and 20 (the angles forming the cutting edges) too sharp to provide cutting edges of sufficient thickness and strength to withstand the stress of wood chipping. Furthermore, repositioning the knife to provide heel clearance would increase the rake angles between the gullet faces and the wood, that is, the angles which determine the fracturing of the wood into chips along the chip surfaces that are not actually cut. Too much rake angle would produce a chip not having an acceptable size, and reshaping the knife to readjust the rake angle would again weaken the cutting edges. Broadening the angle A will also lead to problems, since the efficient cutting angle would be lost. Thus, the angle A should be within an approximate range of 50–55 degrees. Correspondingly, the angle between the surface of the drum or disc and the first cutting edge 35 should be within an approximate range of 35–40 degrees.

Figure 9:
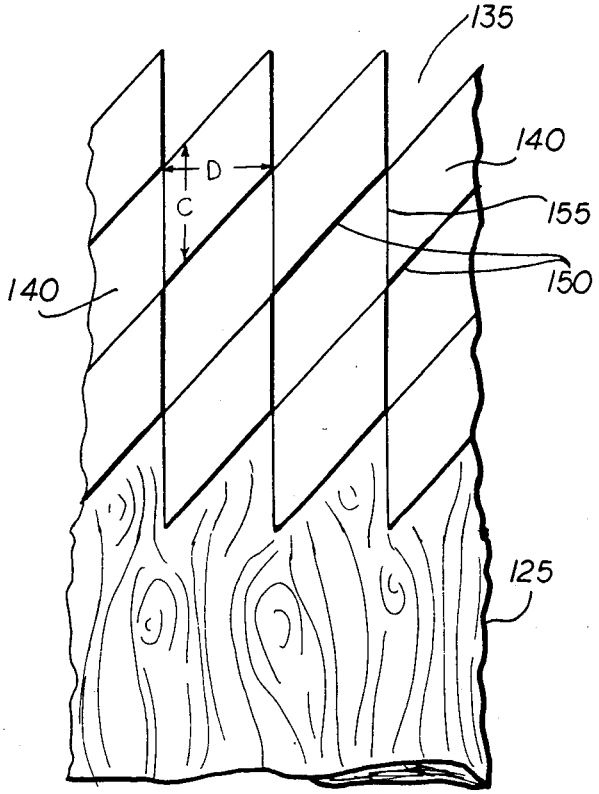
FIG. 9 is a diagrammatic plan view of the pattern of cuts made by knives embodying the present invention.

The preferred embodiment of the present invention cuts a log in the manner shown in FIGS. 9 and 11. FIG. 9 shows the pattern of cuts looking downwardly at the horizontal centerline of the drum 120. The projection of the knife 10 beyond the drum surface is shown by the shaded triangle in FIG. 9. As the cutting edges 35 and 40 of the knife 10 enter the end of the log 125, a precision V-shaped cut through the end grain of the log is made. The first pass of the knives cuts V-shaped grooves 135 in the end of the log 125. As the drum rotates, the knives will make a second cut, removing a strip of wood material having a cross-sectional shape of a parallelogram 140. The knife 10 as shown can be mounted in the drum to provide a rake angle that will cause the strip of wooden material to fracture across the grain at intervals of about $\frac{3}{4}$ inch.

Figures 10, 11A, 11B, 11C, 11D:
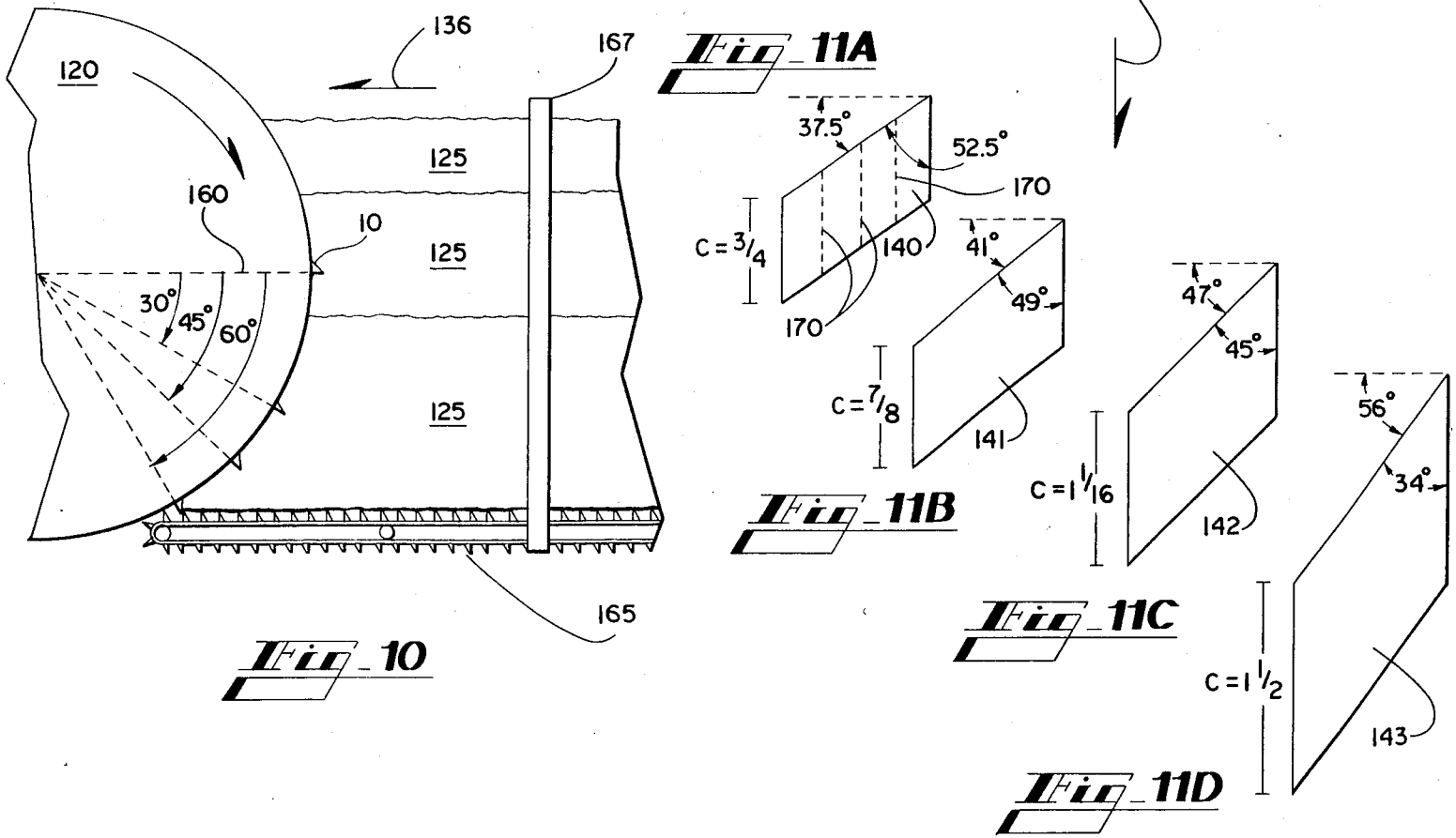
FIG. 10 is a diagrammatic side view of a drum, showing several angular positions of a knife constructed according to the invention, and an assembly for feeding logs into the drum.
FIGS. 11A–11D are diagrammatic representations of wood chips in plan view corresponding to the knife positions shown in FIG. 10.

The dimension C of the chip along the grain is determined by a combination of (a) the projection B of the knife beyond the drum surface, shown as dimension B in FIGS. 7 and 9, and (b) the rotational position of the particular knife around the circumference of the drum. FIG. 10 shows a knife 10 at the horizontal centerline 160, and at positions 30, 45 and 60 degrees from the centerline 160. FIG. 11 illustrates how the dimension C changes as the knife rotates around the drum. At the centerline, the dimension C is about $\frac{3}{4}$ inch. The effective angle being cut by the two cutting edges is the actual angle A between them, as shown in FIG. 11A, because the knife is cutting at right angles to the grain. At 30 degrees from the centerline, a parallelogram 141 is cut. The effective angle is reduced to 49 degrees and the chip dimension C is increased to $\frac{7}{8}$ inch, as shown in FIG. 11B, because the knife is moving partly with the grain, rather than at right angles across it. This effect is increased at 45 degrees from the centerline, where a parallelogram 142 is cut, as shown in FIG. 11C. The effective angle is 43 degrees and the dimension C is 1 1/16 inches. Further around at 60 degrees from the centerline a parallelogram 143 is cut, as shown in FIG. 11D. The effective angle is 34 degrees and the dimension C is $1\frac{1}{2}$ inches.

The dimension D of the parallelograms 140–143 across the grain is determined by the width E of the knife 10 at the drum surface. For a dimension B of $1\frac{1}{2}$ inches as shown in FIG. 9, the dimension E is 2 inches and thus the dimension D is one inch. The dimension D does not change with the rotational position of the knife. By constructing the knife 10 as shown in FIGS. 1–3, the knife can be mounted in the drum 120 in a manner known to those skilled in the art such that the gullet faces 15 and 20 provide rake angles which cause the parallelograms 140–143 to fracture with the grain along three fracture lines 170. This fracturing results in a final chip dimension across the grain of approximately $\frac{1}{4}\times D$, or $\frac{1}{4}$ inch for the knife shown in FIG. 9. Thus, the chip produced by the preferred embodiment of the invention has a length along of grain of approximately $\frac{3}{4}$ inch to $1\frac{1}{2}$ inches, a width across the grain of approximately $\frac{1}{4}$ inch, and a depth perpendicular to the parallelograms 140–143 of approximately $\frac{3}{4}$ inch. All such chip dimensions are accepted as high quality in the wood processing industry. If greater uniformity is desired, the logs can be confined to the region of the centerline of the drum. Any change in the angle A could also affect the chip dimensions.

In the case of a disc chipper embodying the invention, as in FIG. 8, the knives 10 always cut at right angles across the grain, and therefore the length of the chip does not vary with rotational position. Chips produced by the disc chipper 130 have dimensions according to FIG. 11A, and a depth of about $\frac{3}{4}$ inch.

As a result of the angle of the first cutting edge with respect to the end of log 125, the log 125 can be fed perpendicularly into the drum 120 or disc 130 requiring less space for the wood handling apparatus. When a drum type wood processing apparatus is used, several logs can be urged into the apparatus at any one time, and the entire diameter and width of the drum can be utilized. Low power is required to drive the knife through a log so that energy requirements for producing wood chips or flakes can be reduced. For example, a drum 125 carrying a plurality of knives 10 would be effective at a rotational speed of only about 330 RPM and require a power source of only 100–300 horsepower. Also, smaller knives 10 cutting simultaneously at lower speeds will produce lower noise levels during operation of the wood processing apparatus.

The present invention is particularly advantageous as compared to a typical disc chipper having 10–12 radially extending knives that each remove a layer of wood in one revolution of the disc. Several of these long knives may be in the log at once, and may be driven at a speed of, for example, 400 RPM. A large surge of energy is required to force the knives through the wood at high speed, and thus a 104 inch disc chipper may require a motor rated at 1250 horsepower. The log feeds to the disc rapidly (9 inches per revolution for a 12-knife disc cutting ¾ inch chips), but the energy cost is high. In contrast, a drum chipper 120 according to the invention can carry a series of knives 10 spaced to remove one layer of wood for each revolution of the drum. The log feeds at a rate of only ¾" per revolution, but production volume can be maximized by chipping many logs which can occupy a cross-sectional area equal to the length times the diameter of the drum (For example, 50 inches×116 inches). Also, the drum can be rotated using less horsepower, because only one or two small knives are being driven through the wood simultaneously, and there is no large surge required.

The present invention also has significant advantages over prior drum chippers to which logs are fed side on rather than end on. In such chippers, the length of the log to be chipped must be limited to the length of the drum, while the apparatus of the invention can consume a log of any length.

The knife embodying the present invention can also be formed having only single cutting edge corresponding to the first cutting edge 35. Such a knife has the same mechanical advantages as the V-shaped knife but requires additional fracturing along the grain of the wood in order to form a chip. In this case the dimension D in FIG. 9 would not be as precise as when cut by the second edge 40.

While this invention has been described in detail with reference to preferred embodiments thereof, it will be understood that variations and modifications can be made within the spirit and scope of the invention as described hereinabove and as defined in the appended claims.

What is claimed is:

1. A wood processing apparatus comprising:

a cylindrical drum mounted for rotation about a longitudinal axis thereof;

means for feeding a wooden member toward said drum with the grain of said wooden member aligned such that a radius of said drum passes through said wooden member parallel to said grain; and a knife mounted to protrude from the cylindrical surface of said drum, said knife defining a first cutting edge positioned to form an angle of approximately 35 to 40 degrees with the surface of said drum, said cutting edge being coplanar with the longitudinal axis of said drum.

2. The apparatus of claim 1, wherein said knife further comprises a second cutting edge perpendicular to the longitudinal axis of said drum and extending from an end of said first cutting edge farthest from said cylindrical surface of said drum toward said drum.

3. The apparatus of claim 2, wherein said knife further comprises gullet faces and heel faces defining said edges and positioned to fracture wood removed by said knife along at least four fracture lines parallel to said second cutting edge.

4. The apparatus of claim 2, further comprising a third gullet face formed by a knife-receiving block shaped to be matingly received into said groove between said walls, said gullet face spaced inwardly from said first and second edges.

5. The apparatus of claim 2, wherein said first and second cutting edges meet at an angle of approximately 50 to 55 degrees.

6. A wood processing apparatus comprising:

a disc mounted for rotation about an axis and having a generally flat surface perpendicular to said axis;

means for feeding a wooden member toward said surface with the grain of said wooden member aligned perpendicular to said surface; and a knife mounted to protrude from said surface, said knife defining a first cutting edge positioned to form an angle of about 35 to 40 degrees with said surface, said first cutting edge being coplanar with the axis of rotation of said disc.

7. The apparatus of claim 6, wherein said knife further comprises a second cutting edge extending parallel to the axis of rotation of said surface from an end of said cutting surface farthest from said surface toward said surface.

8. The apparatus of claim 7, wherein said knife further comprises gullet faces and heel faces defining said edges and positioned to fracture wood removed by said knife along at least four fracture lines parallel to said second cutting edge.

9. A method of producing wood chips, comprising the steps of feeding a wooden member toward a rotating drum with the grain of said wooden member aligned such that a radius of said drum passes through said wooden member parallel to said grain; and cutting into the end of said wooden member with a knife mounted to protrude from the cylindrical surface of said drum, said knife defining a first cutting edge positioned to form an angle of approximately 35 to 40 degrees with the surface of said drum, said cutting edge being coplanar with the axis of rotation of said drum.

10. A wood chipping knife formed from a blank of metal or the like for use in a wood processing apparatus comprising:

a V-shaped groove defined in one side of said blank having two walls extending to at least one end of said blank to form with said end a first cutting edge and a second cutting edge, said first and second edges meeting at an angle of approximately 50–55 degrees at the vertex of said V-shaped groove;

a first beveled heel face extending from said first edge at an acute angle from one wall of said groove; and a second beveled heel face extending from said second edge at an acute angle from the other wall of said groove.

11. The knife of claim 10, wherein said V-shaped groove extends from said one end of said blank to the other end of said blank; and wherein said beleved heel faces extend unobstructed to edges of said blank, whereby said knife can be efficiently sharpened.

12. A wood processing apparatus comprising:

a cylindrical drum mounted for rotation about a longitudinal axis thereof;

means for feeding a wooden member toward said drum with the grain of said wooden member aligned such that a radius of said drum passes through said wooden member parallel to said grain; and a knife mounted to protrude from the cylindrical surface of said drum, said knife defining a first and a second cutting edge, said first cutting edge positioned to form an angle of approximately 35 to 40 degrees with the surface of said drum and being defined by the intersection at an acute angle of a first gullet face and a first heel face, and said second cutting edge extending within a radial plane of said drum from an end of said first cutting edge farthest from said cylindrical surface of said drum toward said drum and being defined by the intersection at an acute angle of a second gullet face and a second heel face, said first and second gullet faces meeting at an angle equal to the angle between said first and second cutting edges to form a longitudinal groove having a uniform "V"-shaped cross section along the length of said groove.

* * * * *